US007186806B2

(12) United States Patent
Ueda et al.

(10) Patent No.: US 7,186,806 B2
(45) **Date of Patent: *Mar. 6, 2007**

(54) PROCESS FOR PRODUCING REGENERATED COLLAGEN FIBER AND PROCESS FOR SETTING THE SAME

(75) Inventors: Takashi Ueda, Takasago (JP); Takeshi Chiba, Takasago (JP); Kohei Kawamura, Takasago (JP)

(73) Assignees: Kaneka Corporation, Osaka (JP); Hokuyo Co., Ltd., Yamagata (JP)

( * ) Notice: Subject to any disclaimer, the term of this patent is extended or adjusted under 35 U.S.C. 154(b) by 391 days.

This patent is subject to a terminal disclaimer.

(21) Appl. No.: 10/451,398

(22) PCT Filed: Dec. 21, 2001

(86) PCT No.: PCT/JP01/11250

§ 371 (c)(1),
(2), (4) Date: Jun. 23, 2003

(87) PCT Pub. No.: WO02/052099

PCT Pub. Date: Jul. 4, 2002

(65) Prior Publication Data

US 2004/0073010 A1 Apr. 15, 2004

(30) Foreign Application Priority Data

Dec. 22, 2000 (JP) ..... 2000-390767

(51) Int. Cl.
*A61K 38/17* (2006.01)
*A61K 9/70* (2006.01)

(52) U.S. Cl. ..... 530/356; 530/402; 424/443; 424/484

(58) Field of Classification Search ..... 530/356, 530/402; 424/443, 484
See application file for complete search history.

(56) References Cited

U.S. PATENT DOCUMENTS

| | | | | |
|---|---|---|---|---|
| 6,160,096 | A * | 12/2000 | Sakashita et al. | 530/356 |
| 6,242,573 | B1 * | 6/2001 | Goto et al. | 530/356 |
| 6,713,537 | B1 * | 3/2004 | Ueda et al. | 524/17 |
| 6,749,642 | B1 * | 6/2004 | Ueda et al. | 8/127.5 |

FOREIGN PATENT DOCUMENTS

| | | |
|---|---|---|
| EP | 0 548 946 | 6/1993 |
| JP | 04-050370 | 2/1992 |
| JP | 04-352804 | 12/1992 |
| WO | WO 01/00920 A1 | 1/2001 |

* cited by examiner

*Primary Examiner*—Jon Weber
*Assistant Examiner*—Abdel A. Mohamed
(74) *Attorney, Agent, or Firm*—Kenyon & Kenyon LLP

(57) ABSTRACT

The present invention relates to a process for preparing regenerated collagen fiber which comprises treating regenerated collagen fiber with a monofunctional epoxy compound and a metal aluminum salt, in which treatment with the monofunctional epoxy compound initiated by adding sodium hydroxide to become 0.001 to 0.8 N based on the treatment solution and inorganic salt in an amount so that water absorption of the obtained regenerated collagen fiber becomes at most 100%, depending on amount of sodium hydroxide added. Also, the present invention relates to a process for setting regenerated collagen fiber obtained by the above process which comprises thermally setting the fiber by means of wet heat treatment at 50° to 160° C. and drying treatment at 20° to 220° C.

13 Claims, No Drawings

PROCESS FOR PRODUCING REGENERATED COLLAGEN FIBER AND PROCESS FOR SETTING THE SAME

This application is a 371 national phase application of PCT/JP01/11250 filed on 21 Dec. 2001, claiming priority to JP 2000-390767, filed on 22 Dec. 2000, the content of which is incorporated herein by reference in its entirety.

TECHNICAL FIELD

The present invention relates to a process for producing and setting regenerated collagen fiber. More specifically, the present invention relates to a process for producing regenerated collagen fiber which can be easily formed into the desired shape and firmly maintain the shape, and a process for setting the same.

BACKGROUND ART

As the method of making regenerated collagen fiber light in color and water-resistant, JP-A-4-50370, JP-A-6-173161 and JP-A-4-308221 disclose the method for treating collagen fiber with metallic salt such as aluminum salt or zirconium salt and JP-A-4-352804 and JP-A-2000-199176 disclose the method for treating collagen fiber with an epoxy compound. As the method for shaping regenerated collagen fiber, JP-A-4-333660 and JP-A-9-250081 disclose the method which comprises moisturizing the fiber in warm water or an aqueous solution containing monovalent or divalent cationic hydrosulfate and heat-treating the fiber. However, when regenerated collagen fiber made water-resistant by treatment with metallic salt such as aluminum salt or zirconium salt is shaped according to the above method, though shape can be given to the fiber, the ability to maintain the shape (set property) is extremely low. Furthermore, the given shape is lost immediately when washing (including shampoo) and drying are repeated. Thus, using the fiber for hair products such as wigs, hairpieces and doll hair was difficult. Also, uncolored fiber can be obtained by using formaldehyde, but in this case the shaping property of the fiber was not satisfactory. Additionally, when using polyol of glycidyl ether which is regarded to be the most preferable among the epoxy compounds described in JP-A-4-352804, the fiber became brittle and hard and the strength was decreased significantly. Also, problems tend to occur during the process of producing hair ornaments such as implanting hair or operating a sewing machine and the shaping property was not satisfactory.

Furthermore, in the water-insolubilizing reaction of collagen fiber by epoxy compounds disclosed in JP-A-4-352804 and JP-A-2000-199176, when the reaction solution is set to a high pH range in order to reduce the reaction time, the hydrolyzing reaction of the collagen peptide bond advances and obtaining fiber of the desired properties tends to be difficult (deterioration of touch of hair in wet conditions and decline in set ability). As a result, epoxy compound treatment of collagen fiber is preferably conducted under a pH range in which the reaction rate of the epoxy compound and collagen is relatively slow, in order to control the hydrolyzing reaction of the peptide bond. Therefore, this step requires a great deal of time for the collagen fiber to be sufficiently water-insolubilized and is also unsatisfactory as capital investment inflates and productivity decreases.

The object of the present invention is to provide regenerated collagen fiber with light color and excellent touch in wet conditions, which can easily be formed into the desired shape, be set and firmly maintain the shape. The present invention also aims to reduce the treatment time of regenerated collagen fiber by a monofunctional epoxy compound and to improve productivity thereof.

SUMMARY OF THE INVENTION

In view of the present state mentioned above, it has been found that even under a pH range in which the reaction rate of the monofunctional epoxy compound and collagen amino group is relatively high, by adding a specific amount of inorganic salt, swelling of the collagen fiber can be controlled. As a result, hydrolysis of the peptide bond can be controlled and fiber having the desired properties can be prepared in a short period of time.

The present invention relates to a process for producing regenerated collagen fiber which comprises treating regenerated collagen fiber with a monofunctional epoxy compound and a metal aluminum salt, in which treatment with the monofunctional epoxy compound is initiated by adding sodium hydroxide to become 0.001 to 0.8 N based on the treatment solution and inorganic salt in an amount so that the water absorption of the obtained regenerated collagen fiber becomes at most 100% depending on the amount of sodium hydroxide added.

In the above process, the inorganic salt is preferably sodium sulfate.

Also, in the above process, the monofunctional epoxy compound is preferably a compound represented by the formula (I):

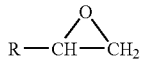

(I)

(wherein R is a substituent group represented by $R^1$—, $R^2$—O—$CH_2$— or $R^2$—COO—$CH_2$—, $R^1$ in the above substituent group is a hydrocarbon group having at least 2 carbon atoms or $CH_2Cl$ and $R^2$ is a hydrocarbon group having at least 4 carbon atoms).

In the above formula (I), $R^1$ is preferably a hydrocarbon group having at least 2 to at most 6 carbon atoms or $CH_2Cl$ and $R^2$ is preferably a hydrocarbon group having at least 4 to at most 6 carbon atoms.

In the above process, the methionine residual group is preferably a sulfoxidized methione residual group or a sulfonated methione residual group.

The order of the above process is preferably treatment of the collagen with the monofunctional epoxy compound and then treatment with metal aluminum salt.

In the treatment with metal aluminum salt in the above process, the content of metal aluminum salt is preferably 0.3 to 40% by weight calculated as aluminum oxide.

As pre-treatment for the above process, collagen is preferably treated with an oxidant, which is preferably hydrogen peroxide.

The present invention also relates to a process for setting regenerated collagen fiber which comprises thermally setting the regenerated collagen fiber obtained by the above production process by means of wet heat treatment at 50° to 160° C. and drying treatment at 20° to 220° C.

DETAILED DESCRIPTION

The regenerated collagen fiber of the present invention is obtained by treating regenerated collagen fiber with a monofunctional epoxy compound and a metal aluminum salt. Preferably, the regenerated collagen fiber is obtained by treatment with a monofunctional epoxy compound and a metal aluminum salt after oxidizing the methionine residual groups of collagen. Also, part or all of the methionine residual groups in the collagen fiber may be a sulfoxidized methionine residual group or a sulfonated methionine residual group.

The raw material of the collagen used in the present invention is preferably split hide. As the split hide, fresh split hide obtained from slaughtered animals such as cows or split hide obtained from salted rawhide may be used. Split hide is composed mainly of insoluble collagen fiber and used after removing reticulated flesh or removing salt added to prevent decay and deterioration.

The insoluble collagen fiber contains impurities such as lipid including glyceride, phospholipid and free fatty acid, and protein other than collagen such as glycoprotein or albumin. These impurities greatly influence spinning stability, quality such as gloss, strength and elongation, and smell when producing fiber. Therefore, the above impurities are preferably removed in advance by conducting conventional leather treatment such as acid or alkali treatment, enzyme treatment or solvent treatment, after disassembling collagen fiber by hydrolyzing lipid in the insoluble collagen fiber soaked in lime.

The insoluble collagen fiber treated in this way is then solubilized in order to disconnect the crosslinked peptides. For solubilization, a known alkali solubilization or enzyme solubilization method that is commonly used may be adopted.

When conducting alkali solubilization, neutralization by acid such as hydrochloric acid is preferable. The method disclosed in JP-B-46-15033 may also be used as an improved method of conventionally known alkali solubilization.

Enzyme solubilization is advantageous in that regenerated collagen having a uniform molecular weight can be obtained and can be suitably used in the present invention. As the enzyme solubilization process, the methods described in JP-B-43-25829 and JP-B-43-27513 may be adopted. Furthermore, in the present invention, both of alkali solubilization and enzyme solubilization may be used together.

As regenerated collagen having excellent quality can be obtained, the collagen solubilized in this way is preferably subjected to further treatment such as pH adjustment, salting out, washing with water or solvent treatment.

The obtained solubilized collagen is dissolved by an acidic solution of which the pH is adjusted to a pH of 2 to 4.5 with an acid such as hydrochloric acid, acetic acid or lactic acid, in order to obtain a concentrate solution having a given concentration of approximately 1 to 15% by weight, preferably approximately 2 to 10% by weight. The obtained collagen aqueous solution may be subjected to defoaming while stirring under reduced pressure or filtration in order to remove water-insoluble minute contaminant according to need. Also, a suitable amount of an additive such as a stabilizer or a water-soluble polymer compound may be added to the obtained solubilized collagen solution in order to improve mechanical strength, water resistance, heat resistance, gloss and spinning properties and to prevent coloring and corrosion.

The solubilized collagen solution is discharged for example from a spinning nozzle or a slit into an inorganic salt aqueous solution to prepare regenerated collagen fiber.

The inorganic salt aqueous solution used for spinning is not particularly limited. However, an aqueous solution of water-soluble inorganic salts such as sodium sulfate, sodium chloride and ammonium sulfate is preferably used and usually the concentration of the inorganic salt is preferably 10 to 40% by weight. The inorganic salt solution is generally adjusted to pH 2 to pH 13, preferably pH 4 to pH 12 by adding metallic salt such as sodium borate or sodium acetate, hydrochloric acid, boric acid, acetic acid or sodium hydroxide. When the pH is less than 2 and greater than 13, the peptide bond in the collagen tends to easily be hydrolyzed and obtaining the desired fiber tends to become difficult. The temperature of the inorganic salt aqueous solution is not particularly limited, but is preferably at most 35° C. When the temperature is higher than 35° C., the solubilized collagen tends to be denatured and the strength of the obtained fiber decreases and so stable production of fiber becomes difficult. The lower limit of the temperature is not particularly limited and can suitably be adjusted depending on the solubility of the inorganic salt.

In the present invention, the regenerated collagen fiber obtained in this way must be treated with a monofunctional epoxy compound or metal aluminum salt.

Examples of the monofunctional epoxy compound used in monofunctional epoxy compound treatment are olefin oxides such as ethylene oxide, propylene oxide, butylene oxide, isobutylene oxide, octene oxide, styrene oxide, methylstyrene oxide, epichlorohydrin, epibromohydrin and glycidol, glycidyl ethers such as glycidyl methyl ether, butyl glycidyl ether, octyl glycidyl ether, nonyl glycidyl ether, undecyl glycidyl ether, tridecyl glycidyl ether, pentadecyl glycidyl ether, 2-ethylhexyl glycidyl ether, allyl glycidyl ether, phenyl glycidyl ether, cresyl glycidyl ether, t-butylphenyl glycidyl ether, dibromophenyl glycidyl ether, benzyl glycidyl ether and polyethyleneoxide glycidyl ether, glycidyl esters such as glycidyl formate, glycidyl acetate, glycidyl acrylate, glycidyl methacrylate or glycidyl benzoate and glycidyl amides. However, the present invention is not limited to these examples.

Of these monofunctional epoxy compounds, the monofunctional epoxy compound represented by the following formula (I) is preferable as the water adsorption of the regenerated collagen fiber is decreased:

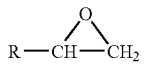

(I)

(wherein R is a substituent group represented by $R_1$—, $R_2$—O—$CH_2$— or $R_2$—COO—$CH_2$—, $R_1$ in the substituent group is a hydrocarbon group having at least 2 carbon atoms or $CH_2Cl$ and $R_2$ is a hydrocarbon group having at least 4 carbon atoms).

Examples of the compound represented by the above formula (I) are butylene oxide, isobutylene oxide, styrene oxide, epichlorohydrin, butyl glycidyl ether, octyl glycidyl ether and glycidyl methacrylate, but not particularly limited to these.

Furthermore, a monofunctional epoxy compound in which $R_1$ in the above formula (I) is a hydrocarbon group having at least 2 to at most 6 carbon atoms or $CH_2Cl$, such as butylene oxide or epichlorohydrin or $R_2$ in the above formula is a hydrocarbon group having at least 4 to at most 6 carbon atoms, such as butyl glycidyl ether or phenyl glycidyl ether are preferably used from the viewpoints that treatment is possible in a short period due to high reactivity and treatment in water is relatively easy.

The amount of the monofunctional epoxy compound is 0.1 to 500 equivalents, preferably 0.5 to 100 equivalents, more preferably 1 to 50 equivalents based on the amount of amino groups which can react with the monofunctional epoxy compound in the regenerated collagen fiber measured by the amino acid analysis method. When the amount of the monofunctional epoxy compound is less than 0.1 equivalent, the insolubilization effect of regenerated collagen fiber to water is insufficient. On the other hand, an amount greater than 500 equivalents is unfavorable from the viewpoint of industrial handling and the environment, though the insolubilization effect may be satisfactory.

In the present invention, the monofunctional epoxy compound is used by dissolving into water, which is the reaction solvent.

The reaction between the monofunctional epoxy compound and the collagen amino group progresses by the amino group nucleophiliclу attacking the monofunctional epoxy compound. Therefore, in order to reduce the reaction time, raising the nucleophilicity of the amino group by raising the pH of the treatment solution is preferable. From this viewpoint, in the present invention, sodium hydroxide must be added to be within the range of 0.001 N to 0.8 N, more preferably 0.003 N to 0.5 N, most preferably 0.004 N to 0.5 N based on the treatment solution when reacting with the monofunctional epoxy compound. When the concentration of sodium hydroxide in the treatment solution is less than 0.001 N, the effect of improving reaction rate cannot be observed. When the concentration of sodium hydroxide in the treatment solution is greater than 0.8 N, swelling of the collagen fiber and hydrolysis of the peptide bond cannot be controlled even when the concentration of inorganic salt is adjusted and fiber having the desired properties cannot be obtained.

However, in monofunctional epoxy compound treatment, as the pH of the treatment solution moves away from around neutral which is the isoelectric point of collagen fiber, the salting out effect of the treatment solution to collagen fiber tends to decrease significantly. This decrease is particularly noticeable in a high pH range in which the reaction rate of the monofunctional epoxy compound and collagen amino group becomes particularly high and as a result, the collagen fiber swells and the peptide bond tends to easily be hydrolyzed. Then, the water absorption of the obtained fiber becomes high and fiber of the desired properties such as water absorption of at most 100% may not be obtained.

Therefore, treatment with a monofunctional epoxy compound must be initiated by adding inorganic salt in an amount so that the water absorption of the obtained regenerated collagen fiber becomes at most 100% depending on the amount of sodium hydroxide.

Examples of the inorganic salt are sodium sulfate, sodium chloride and ammonium sulfate and sodium sulfate is preferable from the viewpoint of industrial handling.

The amount of inorganic salt to make the water absorption of the obtained regenerated collagen fiber at most 100% differs according to the type of inorganic salt, temperature and pH. However, the amount refers to the range of inorganic salt concentration in a randomly set temperature and pH which controls swelling of collagen fiber and makes collagen fiber susceptible to salting out and the water absorption of collagen fiber at most 260%. The amount of inorganic salt added can be determined by measuring the degree of swelling in treatment solution and water absorption of the regenerated collagen fiber to be used. Regarding the degree of swelling, the thickness of the regenerated collagen fiber is visually observed and the degree of swelling is considered preferable when the fiber does not grow significantly thicker than before immersing in the reaction solution.

Specifically, the amount of inorganic salt added must be at least 13% by weight, preferably at least 15% by weight, more preferably at least 17% by weight, when the sodium hydroxide concentration of the reaction solution is at least 0.001 N and less than 0.05 N. When the sodium hydroxide concentration is at least 0.05 N of less than 0.15 N, the amount must be at least 15% by weight, preferably at least 17% by weight, more preferably at least 19% by weight. When the sodium hydroxide concentration is at least 0.15 N and less than 0.35 N, the amount must be at least 16% by weight, preferably at least 19% by weight and when the sodium hydroxide concentration is at least 0.35 N and at most 0.8 N, the amount must be at least 19% by weight. Regarding the upper limit of the amount of inorganic salt, the inorganic salt is added up to an amount so that solution reaches the saturated concentration at 25° C. When the concentration of inorganic salt is out of the above range, the salting out effect of the treatment solution to collagen fiber tends to decrease significantly and as a result, the collagen fiber swells and the peptide bond tends to easily be hydrolyzed. Then, the water absorption of the obtained fiber becomes higher than 100% and fiber of the desired properties may not be obtained.

The water absorption of the obtained regenerated collagen fiber is preferably at most 100%, more preferably at most 90%. When the water absorption is higher than 100%, the fiber lacks hardness when wet and the ability to maintain shape such as curl tends to become weak.

The temperature for treating regenerated collagen fiber with a monofunctional epoxy compound is preferably at most 50° C. When the treatment temperature is higher than 50° C., regenerated collagen fiber is denatured and strength of the obtained fiber decreases and so stable production of fiber becomes difficult.

In addition, various additives such as a catalyst or reaction auxiliary may also be used. Examples of the catalyst are amines and imidazoles. More specifically, examples of the amines are tertiary amines such as triethyl diamine, tetramethyl guanidine, triethanol amine, N,N'-dimethylpiperazine, benzyldimethyl amine, dimethylaminomethyl phenol and 2,4,6-tris(dimethylaminomethyl)phenol, secondary amines such as piperazine and morpholine and quaternary ammonium salts such as tetramethyl ammonium salt, tetraethyl ammonium salt and benzyltriethyl ammonium salt. Examples of the imidazoles include 2-methylimidazole, 2-ethylimidazole, 2-isopropylimidazole, 1-cyanoethyl-2-methylimidazole, 1-cyanoethyl-2-ethylimidazole, 1-cyanoethyl-2-isopropylimidazole, and 2-ethyl-4-methylimidazole. Examples of the reaction auxiliary are salicylic acid or metallic salt of salicylic acid; thiocyanic acid salts such as thiocyanic acid and ammonium thiocyanate; tetramethylthiramdisulfide and thiourea.

In the present invention, the regenerated collagen fiber is washed with water when necessary. Washing with water has the advantage of removing inorganic salt, an unreacted monofunctional epoxy compound or resolvent derived from the monofunctional epoxy compound which are adhered or adsorbed to the regenerated collagen fiber.

In the present invention, the above regenerated collagen fiber is then treated by impregnating into a metal aluminum salt aqueous solution. According to this treatment, hardness is imparted to regenerated collagen fiber when wet, the touch of fiber in wet conditions is improved and shaping such as curl setting becomes favorable.

The treatment is carried out so that the fiber after treatment preferably contains 2 to 40% by weight, more preferably 5 to 20% by weight of aluminum salt calculated as aluminum oxide ($Al_2O_3$). When the amount of aluminum salt in the regenerated collagen fiber is less than 2% by weight calculated as aluminum oxide, touch of fiber in wet conditions becomes poor and shaping such as curl setting becomes weak. When the aluminum salt in the regenerated collagen fiber is greater than 40% by weight calculated as aluminum oxide, the fiber after treatment becomes hard and texture is lost.

The aluminum salt used here is not particularly limited, but aluminum sulfate, aluminum chloride and a commercially available aluminum tanning agent which is commonly used for tanning hide are preferably used. These aluminum salts may be used alone or in a combination of two or more. The concentration of aluminum salt in the aluminum salt aqueous solution is preferably 0.3 to 40% by weight, more preferably 0.5 to 20% by weight calculated as aluminum oxide. When the concentration aluminum salt is less than 0.3% by weight, as the content of aluminum in the regenerated collagen fiber becomes small, touch of fiber in wet conditions becomes poor and shaping such as curl setting becomes weak. When the concentration is greater than 40% by weight, the fiber becomes hard and texture becomes poor.

The pH of the aluminum salt aqueous solution is normally adjusted to a pH of 2 to 6, using hydrochloric acid, sulfuric acid, acetic acid, sodium hydroxide or sodium carbonate. When the pH is less than 2, the reaction ratio of collagen and aluminum salt tends to decrease. When the pH is higher than 6, the aluminum salt precipitates and hardly penetrates into the fiber.

The pH of the aluminum salt aqueous solution is normally adjusted to a pH of 2.5 to 6.5, more preferably a pH of 2.5 to 5.5, using hydrochloric acid, sulfuric acid, acetic acid, sodium hydroxide or sodium carbonate. When the pH is less than 2.5, the structure of the collagen tends to be destroyed and denatured. When the pH is higher than 6.5, the aluminum salt precipitates and hardly penetrates into the fiber. The pH can be adjusted by adding sodium hydroxide or sodium carbonate. The aluminum salt solution is adjusted to a pH of 2.2 to 5.0 and preferably penetrated into the regenerated collagen fiber and then treatment is completed by adjusting the pH to 3.5 to 6.5. When a high basic aluminum salt is used, the initial pH adjustment to 2.5 to 6.5 may be sufficient. The temperature of the aluminum salt aqueous solution is not particularly limited, but preferably at most 50° C. When the temperature of the solution is higher than 50° C., the regenerated collagen fiber tends to become denatured.

The time for penetrating the aluminum salt aqueous solution into the regenerated collagen fiber is preferably at least 10 minutes, more preferably at least 30 minutes. When the penetration time is shorter than 10 minutes, reaction of the aluminum salt has difficulty progressing, improvement in touch of the regenerated collagen fiber in wet conditions is insufficient and shaping such as curl setting tends to become weak. Though the upper limit for the penetration time is not particularly limited, reaction of the aluminum salt progresses sufficiently and touch of the fiber in wet conditions and shaping such as curl setting becomes favorable in 25 hours. Therefore, the penetration time is preferably 25 hours or less.

In order to prevent uneven concentration by rapid absorption of aluminum salt into the regenerated collagen fiber, inorganic salt such as sodium chloride, sodium sulfate and potassium chloride may be added to the above aluminum salt aqueous solution in a concentration of 0.1 to 20% by weight, more preferably 3 to 10% by weight. In order to improve stability of the aluminum salt in water, organic salt such as sodium formate or sodium citrate may be added to the above aluminum salt aqueous solution in a concentration of 0.1 to 2% by weight, preferably 0.2 to 1% by weight.

The regenerated collagen fiber treated with the aluminum salt is then subjected to washing with water, oiling and drying. The regenerated collagen fiber may be washed with running water for 10 minutes to 4 hours. As the oiling agent used for oiling, an oil agent containing emulsion such as silicone modified by an amino group, silicone modified by an epoxy group, silicone modified by polyether and PLURONIC polyether antistatic agent may be used. Drying is carried out at a temperature of preferably at most 100° C., more preferably at most 75° C. under 0.01 to 0.25 gw, preferably 0.02 to 0.15 gw per 1 dtex.

Washing with water is carried out at this stage in order to prevent precipitation of the oiling agent due to salt or to prevent breakage in the regenerated collagen fiber caused by salt precipitated from the regenerated collagen fiber during drying in a dryer. In addition, washing with water prevents decline in heat transfer coefficient caused by the precipitated salt scattering and adhering to the heat exchanger in the dryer. Also, oiling is effective for preventing sticking of the fiber and improving surface properties when drying.

The fiber treated with a monofunctional epoxy compound has the problem that foul odor is generated when applying heat during the drying process and the foul odor is intensified when made into hair material and exposed to a higher temperature by a dryer or hair iron. The reason for the foul odor lies in the sulfur-containing compound generated when the methionine residual group, made unstable by the reaction of the monofunctional epoxy compound with the sulfur atom in the methionine residual group, is thermally decomposed during heat treatment such as drying. Therefore, in treatment with a monofunctional epoxy compound, the reaction of monofunctional epoxy compound and the methionine residual group is preferably prevented, by using regenerated collagen fiber in which the methionine residual group is a sulfoxidized methionine residual group or sulfonated methionine residual group.

Using regenerated collagen fiber in which the methionine residual group is a sulfoxidized methionine residual group or sulfonated methionine residual group is particularly effective when a monofunctional epoxy compound and a metallic salt such as a metal aluminum salt are used together as in the present invention, because in such a case, production of foul odor may be intense, as the metallic salt becomes a catalyst for thermal decomposition.

Due to the above reason, in order to prevent foul odor from generating, treatment is preferably conducted so as the methionine residual group cannot react with the monofunctional epoxy compound. This is conducted by treating the sulfur atom in the methionine residual group with an oxidant at any stage before reacting the monofunctional epoxy compound and regenerated collagen fiber and making the methionine residual group into a sulfoxidized methionine residual group or a sulfonated methionine residual group. In the case of treating solid material such as split hide or regenerated collagen fiber after fiber spinning, treatment is conducted by immersing the solid material in an oxidant or solution thereof. In the case of treating a solubilized collagen aqueous solution, treatment is conducted by adding an oxidant or solution thereof to the collagen aqueous solution and mixing the solution sufficiently.

Examples of the oxidant are peroxides such as peracetic acid, perbenzoic acid, benzoyl peroxide, perphthalic acid, m-chloro perbenzoic acid, t-butyl hydroperoxide, periodic acid, sodium periodate and hydrogen peroxide, nitrogen oxides such as nitrogen dioxide, nitric acid, dinitrogen tetroxide and pyridine-N-oxide, metal oxides such as potassium permanganate, chromic anhydride, sodium bichromate and manganese dioxide, halogens such as chlorine, bromine and iodine and halogenating agents such as N-bromosuccinimide, N-chlorosuccinimide and sodium hypochlorite. Among these, hydrogen peroxide is preferably used since by-products do not remain in the regenerated collagen fiber and handling is easy.

The oxidant is used as it is or by dissolving into various solvents. Examples of the solvent are water, alcohols such as methanol, ethanol or isopropanol, ethers such as tetrahydrofran and dioxane, halogen-containing organic solvents such as dichloromethane, chloroform and carbon tetrachloride and neutral organic solvents such as DMF and DMSO. A mixed solvent thereof may also be used. When water is used as the solvent, an aqueous solution of inorganic salt such as sodium sulfate, sodium chloride and ammonium sulfate may be used when necessary and usually the concentration of such inorganic salt is adjusted to 10 to 40% by weight.

From an industrial point of view, the amount of oxidant used is most preferably an amount in which all of the oxidant used contributes to the reaction. In this case, the amount of oxidant is 1.0 equivalent based on the amount of methionine residual group in the regenerated collagen fiber (according to amino acid analysis, the methionine residual group present in regenerated collagen fiber derived from cow skin is 6 per 1,000 amino acid groups constituting collagen). However, in reality, since some of the oxidant does not contribute to the reaction, the oxidant is preferably used in an amount of at least 1.0 equivalent.

In this way, from the viewpoint of controlling foul odor, at least one part of the methionine residual group in collagen is preferably a sulfoxidized methionine residual group or sulfonated methionine residual group and further, all of the methionine residual groups are preferably a sulfoxidized methionine residual group or sulfonated methionine residual group.

In the case that solid material such as split hide or regenerated collagen fiber after fiber spinning is treated by immersing in an oxidant solution, an amount of oxidant solution in which split hide or regenerated collagen fiber is completely immersed is necessary. The amount of oxidant in this case is at least 1.0 equivalent, preferably at least 5.0 equivalents, more preferably at least 10.0 equivalents, based on the amount of methionine residual group. The concentration of the oxidant in the solution thereof is at least 0.01% by weight, preferably at least 0.1% by weight, more preferably at least 0.5% by weight, most preferably at least 0.8% by weight. When the concentration of the oxidant is less than 0.01% by weight, reaction of the oxidant with the methionine residual group in the collagen has difficulty progressing, as reactive sites decrease. When the amount of the oxidant is less than 1.0 equivalent, the effect of deodorizing regenerated collagen fiber is insufficient. Usually, the temperature for the above treatment is preferably at most 35° C. The treatment time is usually at least 5 minutes and the deodorizing effect is achieved in approximately 10 minutes when treating regenerated collagen fiber. On the other hand, when treating split hide into which oxidant does not permeate easily, the reaction is carried out thoroughly by leaving the split hide immersed in the oxidant solution overnight.

In the case of treating a solubilized collagen aqueous solution, the amount of oxidant used is at least 1.0 equivalent, preferably at least 5.0 equivalents, more preferably at least 10.0 equivalents. The concentration of the oxidant in the solubilized collagen aqueous solution is at least 0.01% by weight, preferably at least 0.05% by weight, more preferably at least 0.1% by weight, most preferably at least 0.2% by weight. When the concentration of the oxidant is less than 0.01% by weight, reaction of the oxidant with the methionine residual group in the collagen has difficulty progressing, as reactive sites decrease. When the amount of oxidant is less than 1.0 equivalent, the effect of deodorizing regenerated collagen fiber is insufficient. Preferably, the above treatment is also carried out at 35° C. or lower. The solubilized collagen aqueous solution after adding the oxidant is mixed sufficiently with a kneader for at least 30 minutes, to bring the oxidant into contact with the collagen.

The regenerated collagen fiber of the present invention can be set in curls as desired or other shapes and firmly maintain the shape, by setting the regenerated collagen fiber by means of wet heat treatment at 50° to 160° C. and drying treatment at 20° to 220° C. The details of the shaping mechanism are unknown. However, it is thought that the hydrogen bond within regenerated collagen fiber is disconnected by wet heat treatment and subsequent drying treatment re-bonds hydrogen bond in the desired shape, to impart firm shape. The temperature of the treatment is critical for imparting firm shape.

The wet heat treatment refers to thermal treatment conducted in the presence of water. The treatment may include spraying mist adjusted to a pre-determined temperature by means of spraying, leaving the regenerated collagen fiber in a vapor atmosphere adjusted to a pre-determined temperature or immersing the fiber in water adjusted to a pre-determined temperature.

Specifically, in a preferable treatment, regenerated collagen fiber is fixed into the desired shape (e.g. spiral shape) and the temperature of the regenerated collagen fiber is adjusted to and maintained at 50° to 160° C. in the presence of water. The temperature of the fiber is measured by inserting a thermocouple into the fiber bundle.

Although determining the amount of water existing on the surface of the regenerated collagen fiber when treating regenerated collagen fiber in the presence of water is extremely difficult, adjusting water on the surface almost uniformly is preferable so that the regenerated collagen fiber is treated equally.

According to this wet heat treatment, when the temperature of regenerated collagen fiber is less than 50° C., disconnection of the hydrogen bonds within the regenerated collagen fiber may not occur and imparting the desired shape becomes difficult. On the other hand, when the temperature of the regenerated collagen fiber is too high, the regenerated collagen fiber may become degenerated. Therefore, the treatment is usually carried out at a temperature of 50° to 160° C., preferably 70° to 120° C., more preferably 75° to 110° C., most preferably 85° to 95° C.

The time for wet heat treatment must suitably be determined according to the atmosphere and temperature adopted for treating regenerated collagen fiber. The fiber is usually treated for at least 1 minute, preferably at least 15 minutes.

The drying treatment refers to treatment for evaporating water from a moist fiber bundle such as placing a fiber bundle into a hot air convection dryer, applying hot air using a dryer or leaving out in the air to dry and a known method may be used. Specifically, the fiber bundle must be dried after wet heat treatment in an atmosphere of a temperature of 20° to 220° C. while maintaining the shape.

A drying temperature lower than 20° C. is unfavorable from the viewpoint of productivity, because the drying time becomes long. On the other hand, when the temperature exceeds 220° C., the regenerated collagen fiber may be denatured and colored. Therefore, the treatment is preferably carried out at a temperature of 20° to 220° C., preferably 90° to 160° C., more preferably 100° to 130° C., most preferably 105° to 115° C.

The time for drying treatment is suitably determined according to the drying temperature, the amount of fiber to be dried and drying device. For example, when drying at a pre-determined temperature of 110° C. using a hot air convection dryer (PV-221 made by Tabai Espec Corporation) the time is preferably at 10 to 30 minutes.

According to these treatments, regenerated collagen fiber can be set and firmly maintain the shape.

Examples of the method for fixing the regenerated collagen fiber into the desired shape are the method of winding regenerated collagen fiber around a pipe or bar, the method of stretching regenerated collagen fiber between two or more supporting points and the method of sandwiching regenerated collagen fiber between plates. Another process may be employed as long as the fiber is fixed into the desired shape and the above wet heat treatment and drying treatment can be conducted.

The regenerated collagen fiber obtained by the present invention is light in color and excellent in touch in wet conditions. Further, the desired shape can be easily imparted and the shape can be firmly maintained. Therefore, the regenerated collagen fiber can suitably be used for hair ornaments such as wigs, hairpieces and doll hair and textile goods of woven fabrics or non-woven fabrics which require shaping (setting).

Hereinafter, the present invention is explained in more detail based on Examples, but the present invention is not limited thereto.

Test Example

Change in the moisture content of the collagen fiber due to the amount of sodium hydroxide added and inorganic salt concentration when treating with a monofunctional epoxy compound (hereinafter moisture content of collagen fiber), water absorption of the regenerated collagen fiber, aluminum content and hair iron heat resistance were measured by the following methods. The methods for curling the regenerated collagen fiber and measuring the curling properties are also described below. Confirmation of odor was also conducted by the method described below.

(Moisture Content of Collagen Fiber)

The moisture content of collagen fiber shown in Table 3 was measured by the following method. A bundle (300 fibers) of regenerated collagen fiber after spinning was trimmed to a length of 50 cm and immersed in an aqueous solution of 25° C. containing sodium sulfate and sodium hydroxide which fulfill the condition of treatment with a monofunctional epoxy compound (the monofunctional epoxy compound is not included) for 1 hour. After the bundle of fiber was taken out of the aqueous solution, the water attached to the surface was thoroughly wiped by a dry filter paper and the weight ($Ww_1$) was measured. Then, the bundle of fiber was dried in a hot air convection dryer (PV-221 made by Tabai Espec Corporation) adjusted to 105° C. for 12 hours and the dry weight ($Wd_1$) was measured. The moisture content was calculated from the following equation (1).

$$\text{Moisture content}=[(Ww_1-Wd_1)/Wd_1]\times 100 \quad (1)$$

(Water Absorption)

After sufficiently opening the regenerated collagen fiber ultimately obtained through steps such as oiling and drying, the fiber was made into a bundle of 22,000 dtex and a 250 mm length. The bundle was then immersed in 200 g of water of 25° C. for 30 minutes so that the fiber would sufficiently absorb water. After taking the bundle of fiber out of the water, the water attached to the surface was thoroughly wiped by a dry filter paper and the weight ($Ww_2$) was measured. Then, the bundle of fiber was dried in a hot air convection dryer (PV-221 made by Tabai Espec Corporation) adjusted to 105° C. for 12 hours and the dry weight ($Wd_2$) was measured. The water absorption was calculated from the following equation (2).

$$\text{Water absorption}=[(Ww_2-Wd_2)/Wd_2]\times 100 \quad (2)$$

(Aluminum Content)

After drying the regenerated collagen fiber in a desiccator, 0.1 g of the fiber was heated and dissolved in a solution obtained by mixing 5 ml of nitric acid and 15 ml of hydrochloric acid. After cooling, the mixture was diluted by fifty times with water and the aluminum content in the diluted aqueous solution was measured using an atomic absorption measurement equipment (Z-5300 model) made by Hitachi, Ltd. The aluminum content measured according to this method refers to the content of metal aluminum alone. The content of aluminum oxide ($Al_2O_3$) was calculated by multiplying this value by 1.89.

(Hair Iron Heat Resistance)

The following procedures were conducted in an atmosphere of a temperature of 20±2° C. and relative humidity of 65±2%.

Fiber was opened sufficiently and made into a bundle of 22,000 dtex and a 250 mm length. The bundle was lightly sandwiched by a hair iron (made by GOLDEN SUPREME INC.) adjusted to various temperatures. Then, sliding of the iron was conducted quickly (approximately 3 seconds) and water on the fiber surface was vaporized. The fiber bundle was sandwiched again by the iron, which was then slid from the root to the tip of the bundle over five seconds. After this procedure, the shrinkage rate of the bundle and frizzing of the fiber tip was examined. The shrinkage rate was calculated from L which indicates fiber length before ironing and Lo which indicates fiber length after ironing (when the bundle became wavy when ironing, the length is measured by straightening the waves) by the following equation (3):

$$\text{Shrinkage rate}=[(L-Lo)/L]\times 100 \quad (3)$$

For hair iron heat resistance, the maximum temperature at which the shrinkage rate was at most 5% and frizzing of the fiber did not occur when ironing was defined as the hair iron heat resistant temperature. The hair iron temperature was set to increments of 10° C. and every time the iron temperature was changed, a new fiber bundle which had not been ironed was used.

(Forming of Curl and Measurement of Curling Properties)

Forming of curl and measurement of curling properties were conducted by the following steps of (1) to (10).

(1) Regenerated collagen fiber after drying was made into a bundle of 300 to 350 fibers and trimmed to a length of 20 cm.

(2) The fiber bundle was wrapped around an aluminum pipe of a 12 mm diameter and both ends of the bundle were fixed to the pipe by rubber bands to prevent the bundle from moving.

(3) The rod to which the fiber was wrapped was placed into a compact steam setter (HA-300P/V, made by Hirayama Seisakusho KK) adjusted to 95° C. for 60 minutes to conduct wet heat treatment.

(4) Then, the rod was taken out from the compact steam setter and dried in a hot air convection dryer (PV-221 made by Tabai Espec Corporation) for 10 minutes.

(5) Next, after the rod was taken out from the hot air convection dryer and cooled at room temperature for about 15 minutes, the fiber bundle was removed from the rod.

(6) The fiber bundle was washed in warm water of 40° C. by shaking 20 times as plain shampooing. After the fiber bundle was then taken out from the warm water, the water attached to the surface was wiped by a towel and removed by shaking. The bundle was hung in a spiral form, and distance (L0 cm) from the knot to the curl tip without load was measured. The bundle was then dried in the hot air convection dryer adjusted to 50° C.

(7) The dried fiber bundle was shampooed by combing 20 times in warm water adjusted to 40° C. containing 0.2% of shampoo (Super Mild Shampoo/Floral Fruity available from Shiseido Co. Ltd.). Then the bundle was lightly rinsed by rubbing under warm running water of 40° C. After water was removed in the same manner as in (6), the bundle was dried again in the hot air convection dryer adjusted to 50° C.

(8) The procedure in (7) was repeated 4 times.

(9) After the fifth shampoo, the bundle was dried by lightly shaking, hung in a spiral form and the distance (Lf cm) from the knot to the curl tip was measured without load.

(10) The property value of curling durability was represented by L0 cm after pre-shampoo and Lf cm after the fifth shampoo.

(Confirmation of Odor)

In consideration of heat treatment of regenerated collagen fiber by a dryer, 10 g of fiber was thermally treated for 10 minutes in a hot air convection dryer adjusted to 100° C. The bundle was immersed in 100 g of water and whether foul odor was generated or not was sensually determined by sniffing the fiber.

EXAMPLE 1

30 g of a hydrogen peroxide aqueous solution diluted to 30% by weight was added to 1,200 g of steer split hide (collagen content: 180 g) solubilized by alkali and the collagen was dissolved into the solution by adding an aqueous solution containing lactic acid, to prepare a concentrate solution adjusted to a pH of 3.5 and solid content of 7.5% by weight. The concentrate solution was subjected to stirring and defoaming under reduced pressure by a stirring defoamer (8DMV model, made by DALTON Co. Ltd., hereinafter the same). The solution was then transferred to a piston type concentrate solution tank for fiber spinning and kept under reduced pressure to carry out further defoaming. The concentrate solution was extruded by piston, supplied in fixed quantities using a gear pump and then filtered through a sintered filter having a pore diameter of 10 μm. The solution was discharged into a coagulation bath of 25° C. containing 20% by weight of sodium sulfate (adjusted to pH 11 by boric acid and sodium hydroxide) through a spinning nozzle having a pore diameter of 0.275 mm, a pore length of 0.5 mm and a pore number of 300 at a spinning rate of 5 m/minute.

Then, the obtained regenerated collagen fiber (300 fibers, 20 m) was immersed into 4 kg of an aqueous solution containing 1.7% by weight of epichlorohydrin (available from Nacalai Tesque Inc.), 0.8% by weight of sodium hydroxide (available from Nacalai Tesque Inc.) and 19% by weight of sodium sulfate (available from Tosoh Corporation) at 25° C. for 4 hours while stirring.

After washing with running water for 30 minutes, the fiber was immersed into 4 kg of an aqueous solution containing 6% by weight of basic aluminum sulfate (Lutan-BN, available from BASF Corporation, hereinafter the same) and 0.5% by weight of sodium formate (available from Nacalai Tesque Inc.) at 30° C. for 15 hours while stirring. Thereafter, the obtained fiber was washed under running water for 2 hours.

Then, part of the prepared fiber was immersed into a bath filled with an oiling agent containing emulsion of amino-modified silicone and a PLURONIC polyether antistatic agent to adhere the oiling agent to the fiber. In a hot air convection dryer (PV-221 made by Tabai Espec Corporation, hereinafter the same) adjusted to 50° C., one end of the fiber bundle was fixed and a weight of 2.8 g was hung to each fiber at the other end. Drying was carried out for 2 hours in a state of tension and then measurement was conducted.

EXAMPLE 2

Experiment was carried out in the same manner as in Example 1 except that treatment with the monofunctional epoxy compound was conducted by immersion into 4 kg of an aqueous solution containing 1.7% by weight of epichlorohydrin, 1.6% by weight of sodium hydroxide and 19% by weight of sodium sulfate at 25° C. for 2 hours.

EXAMPLE 3

Experiment was carried out in the same manner as in Example 1 except that treatment with the monofunctional epoxy compound was conducted by immersion into 4 kg of an aqueous solution containing 1.7% by weight of epichlorohydrin, 0.8% by weight of sodium hydroxide and 17% by weight of sodium sulfate at 25° C. for 4 hours.

EXAMPLE 4

Experiment was carried out in the same manner as in Example 1 except that treatment with the aluminum salt aqueous solution was conducted by immersion into 4 kg of an aqueous solution containing 5% by weight of basic aluminum chloride (Belkotan AC-P, available from Nippon Fine Chemical Co., Ltd.), 6% by weight of sodium chloride (available from Nacalai Tesque Inc.) and 1% by weight of sodium formate at 4° C. for 15 hours.

EXAMPLE 5

30 g of a hydrogen peroxide aqueous solution diluted to 30% by weight was added to 1,200 g of steer split hide (collagen content: 180 g) solubilized by alkali and the collagen was dissolved into the solution by adding an aqueous solution containing lactic acid, to prepare a concentrate solution adjusted to a pH of 3.5 and solid content of 7.5% by weight. The concentrate solution was subjected to stirring and defoaming under reduced pressure by a stirring defoamer. The solution was then transferred to a piston type concentrate solution tank for fiber spinning and kept under reduced pressure to carry out further defoaming. The concentrate solution was extruded by piston, supplied in fixed quantities using a gear pump and then filtered through a sintered filter having a pore diameter of 10 μm. The solution was discharged into a coagulation bath of 25° C. containing 20% by weight of sodium sulfate (adjusted to pH 11 by boric acid and sodium hydroxide) through a spinning nozzle having a pore diameter of 0.275 mm, a pore length of 0.5 mm and a pore number of 300 at a spinning rate of 5 m/minute.

Next, the obtained regenerated collagen fiber (300 fibers, 20 m) was placed in an external solution circulating type treatment device. Then, the fiber was immersed into 1.32 kg of an aqueous solution containing 1.7% by weight of epichlorohydrin, 0.025% by weight of sodium hydroxide and 17% by weight of sodium sulfate at 25° C. for 4 hours while circulating. Further, the temperature of the reaction solution was raised to 43° C. and the fiber was immersed for 2 more hours.

After removing the reaction solution after the reaction was finished, batch washing was conducted 3 times using 1.32 kg of water of 25° C. The fiber was then immersed into 1.32 kg of an aqueous solution containing 5% by weight of aluminum sulfate, 0.9% by weight of trisodium citrate (available from Nacalai Tesque Inc.) and 1.25% by weight of sodium hydroxide at 30° C. 4 hours after the reaction was started, 26.4 g of a 5% by weight sodium hydroxide aqueous solution was added to the reaction solution and the reaction was continued for 2 hours. After removing the reaction solution after the reaction was finished, batch washing was conducted 3 times in the external solution circulating type treatment device using 1.32 kg of water of 25° C.

Then, part of the prepared fiber was immersed into a bath filled with an oiling agent containing emulsion of silicone modified with an amino group and a PLURONIC polyether antistatic agent to adhere the oiling agent to the fiber. In a hot air convection dryer adjusted to 50° C., one end of the fiber bundle was fixed and a weight of 2.8 g was hung to each fiber at the other end. Drying was carried out for 2 hours in a state of tension and then measurement was conducted.

EXAMPLE 6

Experiment was carried out in the same manner as in Example 1 except that hydrogen peroxide solution was not added to the concentrate solution.

COMPARATIVE EXAMPLE 1

Experiment was carried out in the same manner as in Example 1 except that treatment with the monofunctional epoxy compound was conducted by immersion into 4 kg of an aqueous solution containing 1.7% by weight of epichlorohydrin and 13% by weight of sodium sulfate at 25° C. for 2 hours.

COMPARATIVE EXAMPLE 2

Experiment was carried out in the same manner as in Example 1 except that treatment with the monofunctional epoxy compound was conducted by immersion into 4 kg of an aqueous solution containing 1.7% by weight of epichlorohydrin, 0.8% by weight of sodium hydroxide and 13% by weight of sodium sulfate at 25° C. for 4 hours.

COMPARATIVE EXAMPLE 3

Experiment was carried out in the same manner as in Example 1 except that treatment with the monofunctional epoxy compound was conducted by immersion into 4 kg of an aqueous solution containing 1.7% by weight of epichlorohydrin, 4% by weight of sodium hydroxide and 19% by weight of sodium sulfate at 25° C. for 2 hours.

COMPARATIVE EXAMPLE 4

Experiment was carried out in the same manner as in Example 1 except that treatment with aluminum salt was not conducted.

COMPARATIVE EXAMPLE 5

Experiment was carried out in the same manner as in Example 5 except that treatment with the monofunctional epoxy compound was conducted by immersion into 1.32 kg of an aqueous solution containing 1.7% by weight of epichlorohydrin and 17% by weight of sodium sulfate at 25° C. for 4 hours and further immersion for 2 hours after raising the reaction temperature to 43° C.

COMPARATIVE EXAMPLE 6

Experiment was carried out in the same manner as in Example 5 except that treatment with the monofunctional epoxy compound was conducted by immersion into 1.32 kg of an aqueous solution containing 1.7% by weight of epichlorohydrin, 0.025% by weight of sodium hydroxide and 11% by weight of sodium sulfate at 25° C. for 4 hours and further immersion for 2 hours after raising the reaction temperature to 43° C.

REFERENCE EXAMPLE 1

Experiment was carried out in the same manner as in Example 1 except that treatment with the monofunctional epoxy compound was conducted by immersion into 4 kg of an aqueous solution containing 1.7% by weight of epichlorohydrin and 13% by weight of sodium sulfate at 25° C. for 24 hours.

The criteria for evaluating touch in wet conditions and curling are as indicated in Tables 1 and 2.

TABLE 1

| Evaluation of touch in wet conditions | Criteria |
|---|---|
| ○ | Water absorption of at most 90% |
| Δ | Water absorption of more than 90% to at least 100% |
| X | Water absorption of more than 100% |

TABLE 2

| Wavy form evaluation | Criteria |
|---|---|
| ◎ | Very good wave |
| ○ | Good wave |
| Δ | Average |
| X | Bad wavy form |

Regarding the salting out effect due to inorganic salt when the adding sodium hydroxide for treatment with the monofunctional epoxy compound in an amount to attain a concentration of 0.2 N based on the treatment solution, the relationship between the concentration of sodium sulfate and moisture content of the collagen fiber is shown in Table 3.

TABLE 3

| Sodium sulfate concentration (wt %) | Moisture content in collagen fiber (%) |
|---|---|
| 13 | 341 |
| 14 | 282 |
| 15 | 296 |
| 16 | 257 |
| 17 | 255 |
| 18 | 237 |
| 19 | 235 |
| 20 | 252 |

The results of Table 3 indicate that the moisture content of the collagen fiber varies greatly depending on the concentration of sodium sulfate. Specifically, when the concentration of sodium sulfate is in the range of at least 16% by weight, the moisture content of collagen fiber has been found to be at most 260%.

Table 4 shows the conditions for treating collagen fiber by the monofunctional epoxy compound for Examples 1 to 6, Comparative Examples 1 to 6 and Reference Example 1.

TABLE 4

| | Sodium hydroxide concentration in reaction solution (N) | Monofunctional epoxy treatment time (Hr) |
|---|---|---|
| Ex. 1 | 0.2 | 4 |
| Ex. 2 | 0.4 | 2 |
| Ex. 3 | 0.2 | 4 |
| Ex. 4 | 0.2 | 4 |
| Ex. 5 | 0.00625 | 6 |
| Ex. 6 | 0.2 | 4 |
| Com. Ex. 1 | 0 | 2 |
| Com. Ex. 2 | 0.2 | 4 |
| Com. Ex. 3 | 1.0 | 2 |
| Com. Ex. 4 | 0.2 | 4 |
| Com. Ex. 5 | 0 | 6 |
| Com. Ex. 6 | 0.00625 | 6 |
| Ref. Ex. 1 | 0 | 24 |

Table 5 shows the fiber test results for Examples 1 to 6, Comparative Examples 1 to 6 and Reference Example 1.

The results of Table 5 indicate that collagen fiber can be produced without losing the desired properties in 2 to 6 hours (24 hours in Reference Example 1) by a process for producing regenerated collagen fiber comprising treating the regenerated collagen fiber with a monofunctional epoxy compound and metal aluminum salt. In the treatment with the monofunctional epoxy compound, sodium hydroxide must be added to become 0.001 to 0.8 N based on the treatment solution and the amount of inorganic salt must be set to a concentration range by which the water absorption of the obtained collagen fiber becomes at most 100%, depending on the amount of sodium hydroxide added. The collagen fiber produced under these conditions has excellent touch in wet conditions and does not generate foul odor when heated. Furthermore, the results show that firmly imparting any shape is possible when the temperature of the regenerated collagen fiber is maintained at 50° to 160° C. in the presence of water and the fiber is dried in a temperature of 20° to 220° C.

INDUSTRIAL APPLICABILITY

In the process for producing regenerated collagen fiber of the present invention, treatment with the monofunctional epoxy compound of regenerated collagen fiber is conducted by adding sodium hydroxide to become 0.001 to 0.8 N based on the treatment solution and adjusting the concentration range of inorganic salt in the system so that the water absorption of the obtained regenerated collagen fiber becomes at most 100% depending on the amount of sodium hydroxide added. As a result, the salting out effect of collagen fiber is improved, swelling of collagen fiber is prevented, the peptide bond of collagen is protected from hydrolysis reaction and regenerated collagen fiber having excellent touch in wet conditions can be obtained in a short time without losing the desired properties. Therefore, the process for producing regenerated collagen fiber of the present invention is excellent from the viewpoints of reduced facility costs and improved productivity. Furthermore, in the process for producing regenerated collagen fiber of the present invention by maintaining the temperature of the regenerated collagen fiber at 50° to 160° C. in the presence of water and then drying the fiber in a temperature of 20° C. to 220° C., any shape can be firmly imparted. Therefore, the regenerated collagen fiber obtained by the present invention can suitably be used for hair ornaments

TABLE 5

| | Touch in wet conditions | Water absorption (%) | Aluminum content (%) | Hair iron heat resistance (° C.) | Curling durability $L_o \rightarrow L_f$ (cm) | Wavy form | Generation of foul door |
|---|---|---|---|---|---|---|---|
| Ex. 1 | ○ | 82 | 13.8 | 155 | 13.5 → 15.5 | ◎ | none |
| Ex. 2 | ○ | 90 | 12.6 | 155 | 15.0 → 17.0 | ○ | none |
| Ex. 3 | ○ | 84 | 13.4 | 150 | 14.5 → 16.5 | ◎ | none |
| Ex. 4 | ○ | 83 | 13.9 | 155 | 14.5 → 16.5 | ◎ | none |
| Ex. 5 | ○ | 83 | 13.5 | 150 | 14.5 → 16.0 | ◎ | none |
| Ex. 6 | ○ | 86 | 12.9 | 150 | 14.5 → 16.0 | ◎ | generated |
| Com. Ex. 1 | — | — | 0 | — | — | — | — |
| Com. Ex. 2 | X | 102 | 8.6 | 140 | 17.5 → 19.5 | X | none |
| Com. Ex. 3 | X | 131 | 16.2 | — | 17.0 → 20.0 | X | none |
| Com. Ex. 4 | ○ | 85 | 0 | 120 | 18.0 → 20.0 | X | none |
| Com. Ex. 5 | ○ | 126 | 14.5 | 150 | 18.0 → 20.0 | X | none |
| Com. Ex. 6 | X | 113 | 13.5 | — | 17.5 → 20.0 | X | none |
| Ref. Ex. 1 | ○ | 83 | 12.2 | 150 | 14.5 → 16.0 | ◎ | none |

such as wigs, hairpieces and doll hair or textile goods of woven fabrics or non-woven fabrics which require shaping (setting).

The invention claimed is:

1. A process for producing regenerated collagen fiber which comprises treating regenerated collagen fiber with a monofunctional epoxy compound and a metal aluminum salt, wherein treatment with said monofunctional epoxy compound is initiated by adding sodium hydroxide to become 0.001 to 0.8 N based on treatment solution and inorganic salt selected from the group consisting of sodium sulfate, sodium chloride, and ammonium sulfate in an amount which is at least 13% by weight and up to an amount so that solution reaches the saturated concentration at 25° C. when the sodium hydroxide concentration of the reaction solution is at least 0.001 N and less than 0.05 N, at least 15% by weight and up to an amount so that solution reaches the saturated concentration at 25° C. when the sodium hydroxide concentration is at least 0.05 N and less than 0.15 N, at least 16% by weight and up to an amount so that solution reaches the saturated concentration at 25° C. when the sodium hydroxide concentration is at least 0.15 N and less than 0.35 N, at least 19% by weight and up to an amount so that solution reaches the saturated concentration at 25° C. when the sodium hydroxide concentration is at least 0.35 N and at most 0.8 N.

2. The process of claim 1, wherein a methionine residual group in collagen is a sulfoxidized methione residual group or a sulfonated methione residual group.

3. A process for setting regenerated collagen fiber produced by the process of claim 1, which comprises thermally setting said regenerated collagen fiber by means of wet heat treatment at 50° to 160° C. and drying treatment at 20° to 220° C.

4. The process of claim 1, wherein said inorganic salt is sodium sulfate.

5. A process for setting regenerated collagen fiber produced by the process of claim 4, which comprises thermally setting said regenerated collagen fiber by means of wet heat treatment at 50° to 160° C. and drying treatment at 20° to 220° C.

6. The process of claim 1, wherein said monofunctional epoxy compound is a compound represented by formula (I):

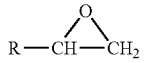

(I)

wherein R is a substituent group represented by $R^1$—, $R^2$—O—$CH_2$—or $R^2$—COO—$CH_2$—, $R^1$ in said substituent group is a hydrocarbon group having at least 2 carbon atoms or $CH_2Cl$ and $R^2$ in said substituent group is a hydrocarbon group having at least 4 carbon atoms.

7. The process of claim 6, wherein $R^1$ of said formula (I) is a hydrocarbon group having at least 2 to at most 6 carbon atoms or $CH_2Cl$ and $R^2$ of said formula (I) is a hydrocarbon group having at least 4 to at most 6 carbon atoms.

8. A process for setting regenerated collagen fiber produced by the process of claim 6, which comprises thermally setting said regenerated collagen fiber by means of wet heat treatment at 50° to 160° C. and drying treatment at 20° to 220° C.

9. A process for setting regenerated collagen fiber produced by the process of claim 7, which comprises thermally setting said regenerated collagen fiber by means of wet heat treatment at 50° to 160° C. and drying treatment at 20° to 220° C.

10. The process of claim 1, wherein said regenerated collagen fiber is treated with said monofunctional epoxy compound and then treated with said metal aluminum salt.

11. The process of claim 10, wherein content of metal aluminum salt in treatment with said metal aluminum salt is 0.3 to 40% by weight calculated as aluminum oxide.

12. The process of claim 10, wherein said regenerated collagen fiber is treated with an oxidant for pre-treatment.

13. The process of claim 12, wherein said oxidant is hydrogen peroxide.

* * * * *